US005862724A

United States Patent [19]

Arata et al.

[11] Patent Number: 5,862,724

[45] Date of Patent: Jan. 26, 1999

[54] SCREW DRIVING METHOD AND SCREW DRIVING APPARATUS

[76] Inventors: Ken Arata; Satoshi Fujii, both c/o Kanematsu-NNK Corporation, 2-12, Shinkiba 3-Chome, Koto-Ku, Tokyo 136, Japan

[21] Appl. No.: 930,985

[22] PCT Filed: Feb. 7, 1997

[86] PCT No.: PCT/JP97/00324

§ 371 Date: Oct. 8, 1997

§ 102(e) Date: Oct. 8, 1997

[87] PCT Pub. No.: WO97/28927

PCT Pub. Date: Aug. 14, 1997

[30] Foreign Application Priority Data

Sep. 2, 1996 [JP] Japan ..... 8-024267

[51] Int. Cl.[6] ..... B25B 23/06

[52] U.S. Cl. ..... 81/434; 81/57.37; 173/159

[58] Field of Search ..... 81/57.37, 434, 81/57.44; 173/157, 159

[56] References Cited

U.S. PATENT DOCUMENTS 2,383,380 8/1945 Gimpel ..... 173/159 X
5,231,902 8/1993 Uno et al. ..... 81/57.44

FOREIGN PATENT DOCUMENTS 0338406 10/1989 European Pat. Off. .
4219032 12/1992 Germany .
61-257784 11/1986 Japan .
64-45581 2/1989 Japan .
6-315870 11/1994 Japan .
7-171770 7/1995 Japan .

*Primary Examiner*—James G. Smith

[57] ABSTRACT

When a screw 14 is driven into workpieces 61 and 62, it is possible to reduce any reaction that a driver bit 11 is raised so as to obtain fast and reliable screw driving. In the screw driving method of the present invention, the screw is advanced with a strong pressing force of 7–10 Kg during a period from disengagement step of the screw from a carrier strip 14 to driving step of the tip of the screw to the predetermined depth (the lower surface) of the workpiece 61. When the screw is screwed into the workpiece 62, the driver bit 11 is advanced with a weak pressing force of 2–3 Kg. In a screw driving apparatus of the present invention, the fitted screw is disengaged from a screw carrier strip by means of a forward stroke force of the driver bit. The tip of the screw is driven to a predetermined depth in a workpiece. During the term between the disengagement and the driving of the screw, the driver bit is advised with a strong pressing force by a primary piston 26. Then, the screw 14 is screwed into the workpiece 62 by advancing the driver bit 11 with a weak pressing force by a secondary piston 27 which passing through the center of the primary piston 26. The driver bit 11 is rotated by an air motor 31.

4 Claims, 6 Drawing Sheets

SCREW DRIVING METHOD AND SCREW DRIVING APPARATUS

TECHNICAL FIELD

The present invention relates to screw driving method and apparatus wherein the tip of a driver bit is fitted into the groove of the head of a screw, the fitted screw is disengaged from a screw carrier strip by a forward stroke force of the driver bit, the tip of the screw is driven to a predetermined depth in a workpiece, and the screw is screwed by rotating the driver bit.

BACKGROUND ART

An apparatus for fitting the tip of a driver bit into the groove on the head of a screw, disengaging the fitted screw from a screw carrier strip by a forward stroke force of the driver bit and driving the screw into a workpiece while rotating the driving bit is publicly known as Japanese Patent Laid-Open No. 7-171770 (JP-A-7-171770). In this screw driving apparatus, in order to solve the problem such a reaction that the driving apparatus is raised when the screw pressed against the workpiece is driven, a moving piston for advancing a driver bit is connected through a spring to the driver bit. The piston can move forward in the way that it compresses the spring even when the driver bit abuts against the workpiece to resist further advance, thereby it preventing the reaction in the direction that the apparatus tends to be raised.

Nevertheless, the above screw driving apparatus described in Japanese Patent Laid-Open No. 7-171770 (JP-A-7-171770) causes additional reaction if a strong spring to meet a strong pressing force is used for high-speed pressing and high-speed driving of screws because a greater pressing force is required for screwing them in after they abut against the workpiece. On the contrary, the use of a weak spring decreases the speed of pressing screws to slow the driving operation. It is also feared that failure in disengaging screws from a screw carrier strip or in fitting of the tip of the driver bit into the groove on the screw head may arise to hinder the driving operation.

DISCLOSURE OF INVENTION

Accordingly, the present invention aims to provide a screw driving method which is capable of driving screws reliably with less reaction and at a high speed.

Another object of the invention is to provide a screw driving apparatus which is capable of driving screws reliably with less reaction and at a high speed.

The inventor of the present invention analyzes by experiments that in the screw driving apparatus, a strong pressing force of 7 Kg to 10 Kg is required during the period between disengaging a screw from the screw carrier strip and driving the tip of the screw to a predetermined depth in a workpiece, and then a weak pressing force of about 2 Kg or 3 Kg is sufficient when the screw being rotated is screwed into the workpiece. This is because after the screw has been driven into the workpiece to a certain extent, further applying a pressing force of the same strength causes the screw to be driven in like a nail, not to be properly screwed in, so that a sufficient pulling resistance as required of the screw is not obtained.

The present invention provides a screw driving method comprising steps of fitting the tip of a driver bit into the groove on a screw head, disengaging the fitted screw from a screw carrier strip under a forward stroke force of the driver bit, driving the tip of the screw to a predetermined depth in a workpiece, and screwing the screw in while rotating the driver bit. The method is characterized in that the screw driving method comprises: steps of advancing the driver bit with a strong pressing force by a primary piston during a period between the step of fitting the tip of the driver bit into the groove on the screw head and the step of driving the tip of the screw to the predetermined depth in the workpiece; and when the screw is screwed into the workpiece after the driving of the screw into the workpiece, advancing the driver bit with a weak pressing force by a secondary piston which passes through the primary piston.

The present invention also provides a screw driving apparatus which has a cylinder, piston means reciprocating in the cylinder by means of compressed air, a driver bit driven by the pistons, and means to rotate the driver bit, wherein the tip of the driver bit is fitted into the groove on the head of a screw, the fitted screw is disengaged from a screw carrier strip by means of a forward stroke force of the driver bit, the tip of the screw is driven to a predetermined depth in a workpiece and the screw is screwed into the workpiece by the rotating driver bit. The apparatus is characterized in that the piston means comprise a hollow primary piston capable of reciprocating axially with respect to the cylinder in contact with the inner wall of the cylinder and a secondary piston capable of reciprocating in the primary piston and piercing through the hollow portion of the primary piston axially with respect to the cylinder; and the secondary piston is connected to the driver bit through the driver bit rotating means; the primary piston has a compressed air receiving area larger than the pressure receiving area of the secondary piston; the apparatus is adapted to advance the diver bit with a strong pressing force by the primary piston during a period that the tip of the driver bit is fitted into the groove of the screw head and then the tip of the screw is driven to the predetermined depth in the workpiece; and the apparatus further comprises means to stop the advance of the primary piston after the screw has been driven into the workpiece so that the driver bit can be advanced with a weak pressing force caused only by the advance of the secondary piston.

As described in the above, the primary piston advances the driver bit with a strong pressing force during the period from the fitting of the tip of the driver bit into the groove of the screw head to the driving of the tip of the screw to a predetermined depth in the workpiece, and then screwing-in of the screw is carried out by the rotation of the driver bit which is advanced with a weak pressing force by the secondary piston. This makes it possible to drive the screw at a high speed until the tip of the screw is driven to a predetermined depth in the workpiece, and a weak pressing force of about 2–3 Kg is used to screw the screw in, resulting in reliable screwing-in of the screw and reducing reaction on the apparatus.

In the apparatus according to the present invention, the driver bit rotating means comprises an air motor connected to the secondary piston and the secondary piston is formed with a passage for feeding compressed air to the air motor, thereby obtaining a compact screw driving apparatus.

In this arrangement, an opening for compressed air to pass through is formed in an upper portion of the secondary piston. The opening remains closed when the secondary piston is in its stationary position, but when the secondary piston is advanced, compressed air in the cylinder is fed through the opening to the air motor. Thus, movement of the secondary piston is synchronized with the rotation of the driver bit.

It is also possible to arrange so that the compressed air passage is sealed to stop feeding compressed air to the air motor when the secondary piston reaches the most advanced position where screwing-in of the screw is completed.

BEST MODE OF CARRYING OUT THE INVENTION

Figure 1:
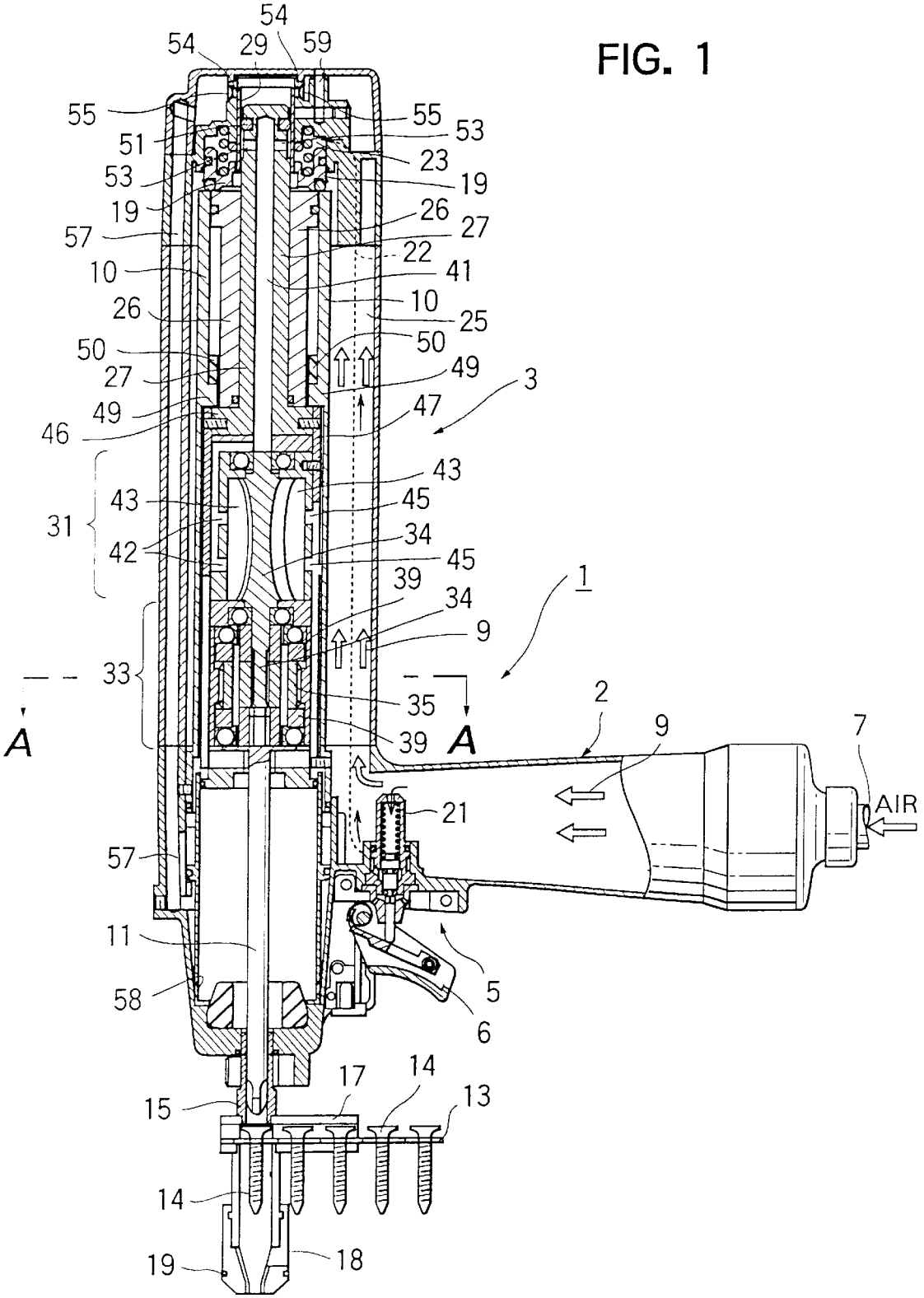
FIG. 1 is sectional view showing a screw driving apparatus according to the present invention in its stationary position.

The present invention is described further by way of an embodiment, referring to the accompanying drawings. In FIG. 1, a screw driving apparatus 1 according to the present invention is shown in the state before starting its screw driving operation, that is, in its stationary state. The screw driving apparatus 1 comprises a handle 2 and a body 3. The handle 2 is provided with a trigger device 5 for actuating driving operation, and the screw driving apparatus is actuated when a trigger lever 6 is triggered. To an end 7 of the handle 2 compressed air is fed and the hollow portions of the handle 2 and the body 3 are filled with compressed air as shown by arrows 9 and the hollows portions serve as reservoirs of compressed air. The handle 2 can be adapted to hold a magazine (not shown) to contain a coiled screw carrier strip.

In the drawing, the body 3 is provided with a cylinder 10 extending vertically to cover substantially the overall length of the body. Inside the cylinder 10, means to move a driver bit 11 vertically and means to rotate the driver bit are provided. Details of these means are described later. In its lower portion, the body 3 is provided with a nose 15 in which a plurality of screws 14 removably held by a carrier strip 13 are placed. The nose 15 is provided with a feeder 17 to guide the screw carrier strip 13, which the feeder serves so that each screw 14 can be positioned on the axis of the driver bit 11. The end of the nose 15 is attached with a chuck 18 which enables the screw 14 disengaged from the carrier strip to be kept in its proper position and to be pressed by downward movement i.e., a forward stroke, of the driver. The lower end of the chuck 18 is biased by an O-ring 19 in the direction in which it is closed and the chuck keeps the screw 14 in the proper position and guides it smoothly in the direction of driving.

A main valve 19 is positioned an upper portion of the cylinder 10 of the body 3 to control feeding of compressed air to the cylinder 10. The main valve 19 moves between a lower stationary position (the position shown in FIG. 1) in which it stops the feed of compressed air from the reservoir to the cylinder 10 and an upper driving position (the position shown in FIGS. 4 through 6) in which compressed air is fed to an upper portion of the cylinder 10. The returned position shown in FIG. 6 is the same as the stationary position in FIG. 1. The main valve 19 is controlled by the trigger device 5. In the trigger device 5, during the stationary period in which the trigger lever is not pulled, compressed air in the reservoir of the handle 2 is fed through a trigger valve 21 to a passage 22 (shown by broken lines in FIG. 1) formed in the body and the compressed air which has passed through the passage 22 is fed to a main valve chamber 23 above the main valve 19. The compressed air being fed to the main valve chamber 23 presses the main valve 19 down to the stationary position.

When the trigger lever 6 is triggered, i.e., at the time of driving, the trigger valve 21 discontinues feeding of compressed air to the passage 22, and then, the compressed air of the main valve chamber 23 passes through the passage 22 and the trigger valve 21, and is discharged from a point close to the trigger lever 5 to the atmosphere. The discharge of the compressed air reduces the pressure in the main valve chamber 23 so that the force pressing the main valve 19 is no longer present. On the other hand, compressed air from a reservoir 25 of the body 3 works on the bottom surface of the main valve 19 and moves the main valve 19 from the stationary position to the upper driving position. By this movement, the main valve 19 leaves the top of the cylinder 10 open for compressed air to be fed from the reservoir 25. Since the relation between the main valve and the trigger device 5 is the same as in publicly known nail driving apparatuses, further description is omitted.

Now, description is made on other components of the screw driving apparatus 1 according to the present invention, including means to move the driver bit 11 vertically, that is, to reciprocate it, and means to rotate the driver bit. The driver bit 11 is reciprocated by pistons which are moved vertically, i.e., reciprocated in the cylinder 10 by means of compressed air. According to the present invention, there are two pistons; a hollow primary piston 26 capable of reciprocating axially with respect to the cylinder 10 in contact with the inner wall of the cylinder 10, and a secondary piston 27 capable of reciprocating in the primary piston 26 passing through the hollow portion of the primary piston 26, axially with respect to the cylinder 10. The area for receiving the pressure of compressed air on the top of the primary piston 26 is formed so as to be larger than that of the secondary piston 27. Owing to this, when the same air pressure is applied, the primary piston 26 descends more powerfully and at a higher speed than the secondary piston 27, which descends slowly with a weak pressing force. The secondary piston 27 extends over the top of the primary piston and an upper portion of the secondary piston 27 reciprocates vertically inside a secondary cylinder 29 on which the inner side of the main valve 19 slides.

The secondary piston 27 extends through the primary piston 26. An air motor 31 as means to rotate the driver bit 11 is attached to a lower portion of the secondary piston. The air motor 31 comprises, for example, the so-called vane motor as described, for example, in the Japanese Patent Laid-Open No. 7-171770 (JP-A-7-171770) and it is formed so as to move as a unit, together with the secondary piston 27, inside the cylinder 10. To a lower portion of the air motor 31, a planetary gear type reduction gear 33 is attached as a part of the unit, integrally with the air motor 31. The driver bit 11 is the output shaft of the reduction gear 33.

Figure 2:
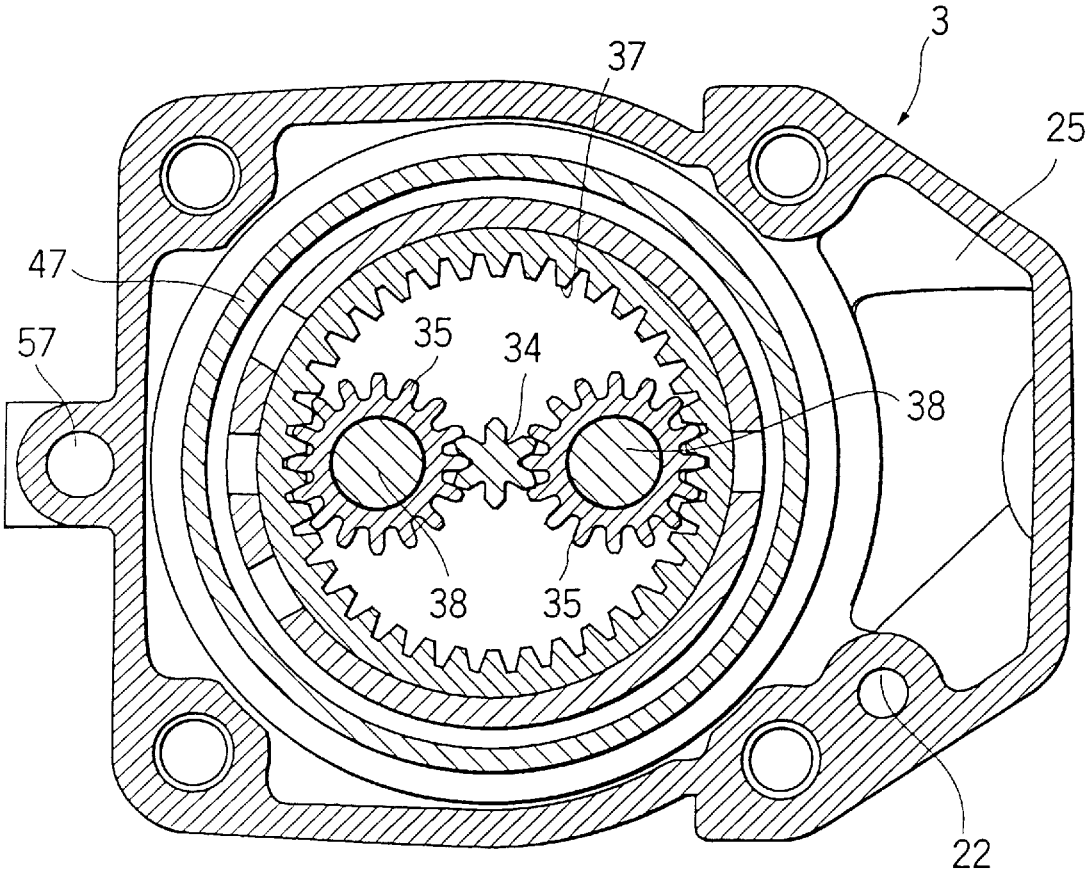
FIG. 2 is a sectional view taken along the line A—A of the screw driving apparatus of FIG. 1.

FIG. 2 is a cross sectional view of the planetary reduction gear 33. A shaft 34 functions as a sun gear and two planetary gears 35 to rotate round it are provided. An internal gear 37 is fixed to the outer sides of the planetary gears 35. Since the internal gear 37 is fixed, the planetary gears 35 are made to rotate on their own axes by the rotation of the shaft 34 and make orbital motions round the shaft 34. The orbital motions are transmitted to rotary discs 39 (FIG. 1) connected to the upper and lower ends of the shaft 38 of each planetary gear 35. The driver bit 11 connected to the lower rotary disc 39 rotates at a low speed so as to obtain a predetermined speed of revolution and torque from the shaft 34 of the air motor 31.

Compressed air is supplied from the reservoir 34 to the air motor 31 to rotate the shaft 34. For this purpose, the secondary piston 27 is formed with an axial hole which defines a compressed air passage 41 for feeding compressed air in the cylinder 10 to the air motor 31. The compressed air fed through the compressed air passage 41 hits on vanes 43 through intake ports 42 and rotates the shaft 34. Then, the compressed air is discharged outside the body 3 through discharge ports 45.

A lower portion 46 of the secondary piston 27 has a larger diameter than the lower portion of the primary piston 26 so that the secondary piston 27 is forced to move forward by the advance of the primary piston 26. The lower portion 46 of the secondary piston 27 is connected to a housing 47 which surrounds the outer sides of the air motor 31 and the planetary reduction gear 33. Further, a lower portion of the housing 47 is connected to an upper portion of the driver bit 11 rotatably but axially unmovably. These portions connect the secondary piston 27, the air motor 31, the reduction gear 33 and the driver bit 11 integrally with each others. Thus, the vertical reciprocation of the secondary piston 27 causes the driver bit 11 to reciprocate vertically.

The length of the primary piston 26 is determined so as to move by a predetermined stroke length. In its stationary position, movement of the primary piston 26 is limited to prevent the piston from going beyond the upper end of the cylinder 10 and also to prevent it from descending below the lowermost driving position (see FIG. 4) by a small diameter portion or stop portion 49 formed at a mid-height of the cylinder 10. Above the stop portion 49, a bumper 50 is provided to reduce impact caused when the primary piston 26 stops advancing. The stroke length of the primary piston 26 is determined so that the tip of the driver bit 11 stays above the screw 14 in the nose 15 in the upper stationary position, and at the lowermost driving position (FIG. 4), the tip of the driver bit 11 drives the tip of the screw 14 into a predetermined depth in the workpiece (in the illustrated example, it is driven until an attachment member 61 such as a gypsum board on the upper side is penetrated). Therefore, when the primary piston 26 moves from the upper stationary position to the lower driving position, the driver bit 11 is forwardly moved together with the secondary piston 27 by the length of that stroke, and in the position shown in FIG. 4, the driver bit 11 drives the screw 14 to the predetermined depth in the workpiece (61 and 62).

The secondary piston 27 is longer than the primary piston 26 and has a longer stroke than the primary piston 26. Accordingly, the secondary piston 27 staying in the most advanced position where the screw abuts against the workpiece can advance to reach the position of FIG. 5 where it completes driving by rotating the screw to screw it in. Upon completion of the driving, feeding of compressed air through the compressed air passage 41 of the secondary piston 27 to the air motor 31 is discontinued to stop the rotation of the driver bit 11. For this purpose, the upper end of the secondary piston 27 is provided with an O-ring 51 which seals the hollow portion of the primary piston 26. An opening 53 serving as a supply port for the compressed air passage 41 is formed below the O-ring 51 and the top surface of the secondary piston 27 remains closed. When the secondary piston 27 advances and the O-ring abuts on the inner wall of the primary piston 26, the compressed air in the cylinder 10 is no longer fed to the passage 41 of the secondary piston 27. This stops the operation of the air motor 31 and the driver bit 11 ceases to rotate, thereby stopping the screwing-in of the screw, too.

Figure 5:
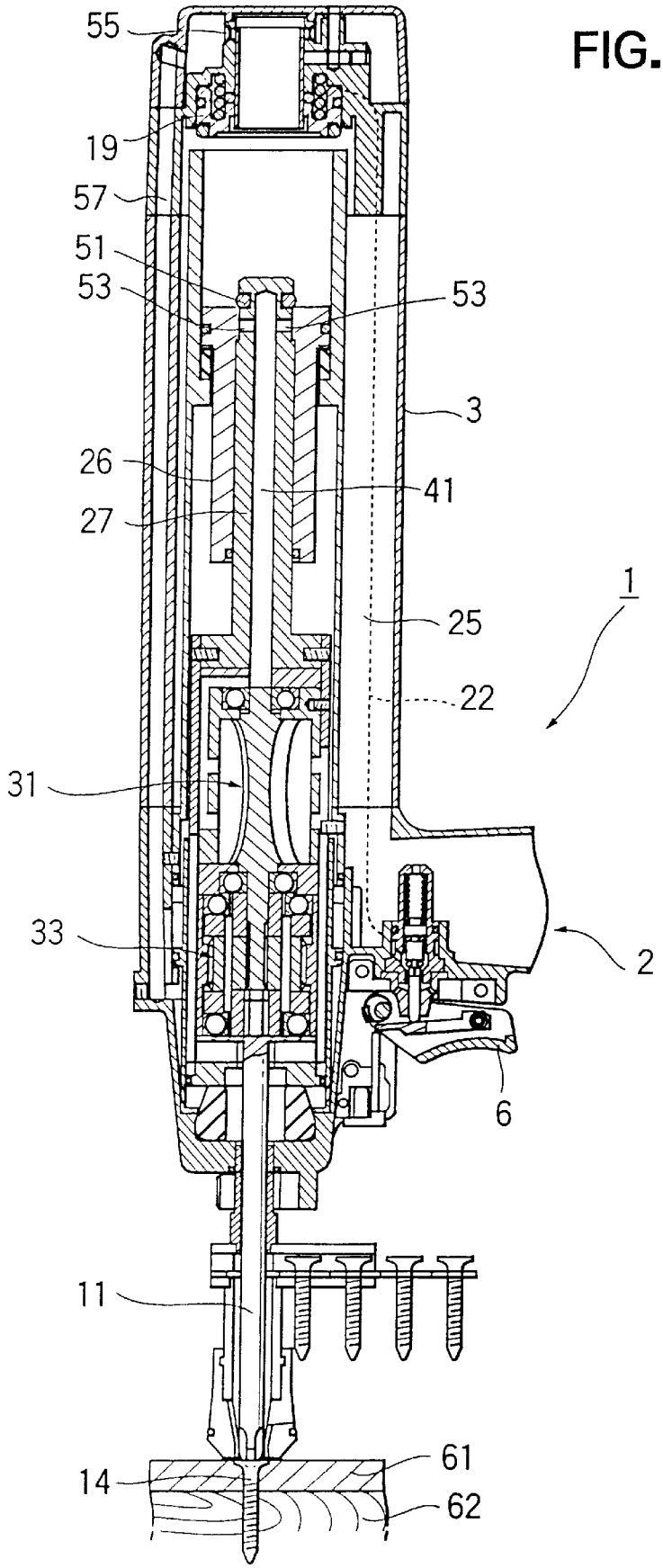
FIG. 5 is a sectional view of the screw driving apparatus in which screwing operation has just been completed.
Figure 6:
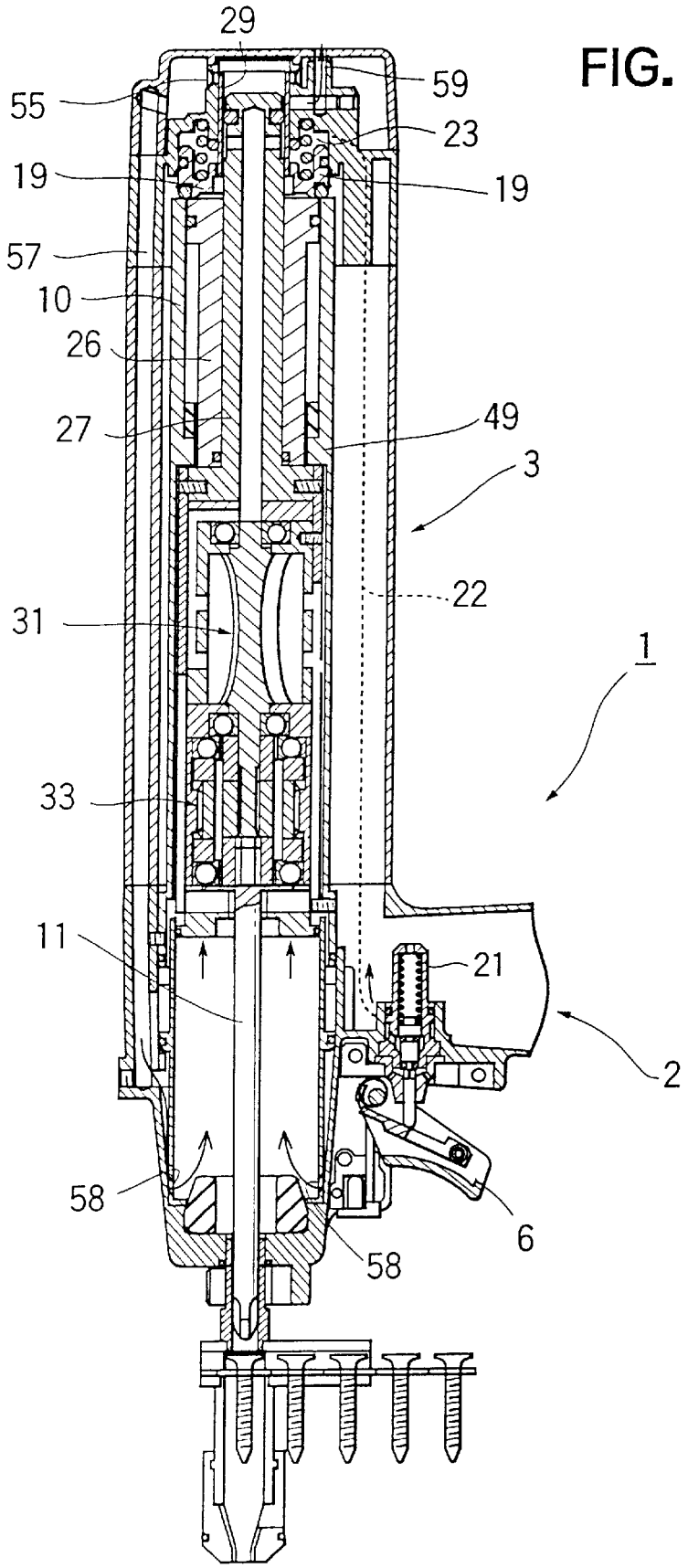
FIG. 6 is a sectional view of the screw driving apparatus returned to the stationary position by releasing the trigger lever.

After the completion of driving as shown in FIG. 5, releasing the trigger lever 6 returns the driver bit 11, the planetary reduction gear 33, the air motor 31, the secondary piston 27 and the primary piston 26 to the stationary positions shown in FIGS. 1 and 6. For this return, a certain number of holes 54 are formed circumferentially at the upper end of the secondary cylinder 29 provided above the cylinder 10, and a resilient O-ring 55 provided to close the holes 54 from outside forms a check valve 55. The compressed air which passes through the check valve 55 is fed to a lower portion of the cylinder 10 through a return discharge path 57 extending downwardly on a side of the body 3. In a lower portion of the cylinder 10, a hole 58 is formed and compressed air from the return discharge path 57 is sent below the reduction gear 33. The secondary cylinder 29 above the cylinder 10 is provided with, at a position separated from the check valve 55, a compressed air escape hole 59 for reducing pressure so as to return the upper end of the secondary piston 27 to the secondary cylinder 29. The compressed air escape hole 59 has a small diameter which is just enough to discharge compressed air to the atmosphere little by little without affecting the driving operation by means of compressed air. The driver bit 11, the planetary reduction gear 33, the air motor 31, the secondary piston 27 and the primary piston 26 are pressed upward by the check valve 55, the return discharge path 57, the hole 58 in the lower portion of the cylinder and the compressed air return hole 59 and return to their stationary positions. Their return motions are further described later.

The operation of the screw driving apparatus 1 is described in the following. Compressed air is fed from a compressor or the like to the port at the end 7 of the handle 2 to fill the reservoir in the handle 2 and the reservoir 25 in the body 3. As shown in FIG. 1, the trigger is not pulled in the stationary state. Compressed air is fed to the main valve chamber through the trigger valve 21 and the passage 22. The main valve 19 is in the lower stationary position to close the upper end of the cylinder 10. Since compressed air is not fed to the cylinder 10, the primary piston 26 and the secondary piston 27 are in their upper stationary positions. The air motor 31 does not operate with the driver bit 11 also staying in the upper stationary position.

Figure 3:
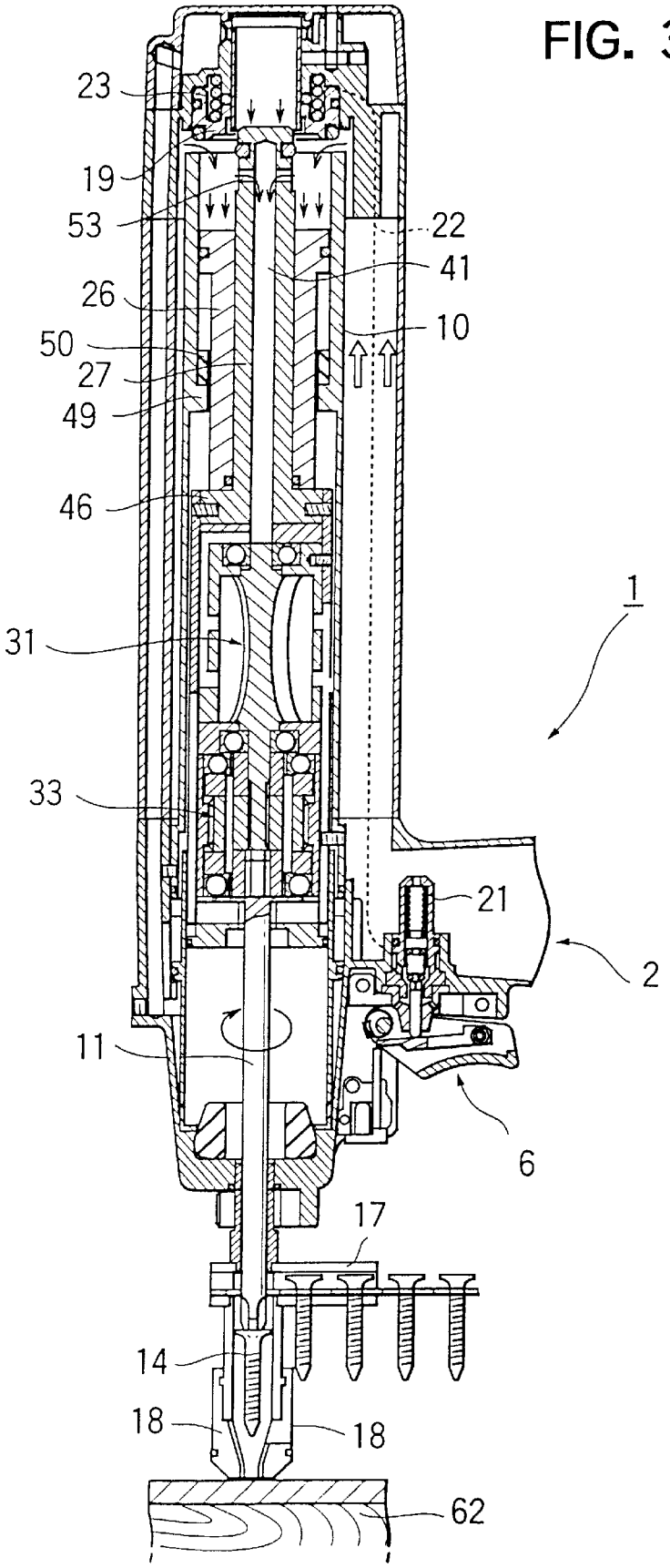
FIG. 3 is a sectional view of an initial stage of driving operation of the screw driving apparatus according to the present invention.

Next, triggering of the trigger lever 6 allows the compressed air in the main valve chamber 23 to be discharged through the passage 22 and the trigger valve 21, leaving no pressing force on the main valve 19. Since the compressed air in the reservoir 25 always works on the lower periphery of the main valve 19 to push up the main valve 19, the main valve is pressed upward. Once the main valve 19 is pushed up, the upper end of the cylinder 10 is opened. The compressed air in the reservoir 25 is fed to the cylinder and acts on the top surface of the primary piston 26 to press down the primary piston 26. When the primary piston 26 is pressed down as shown in FIG. 3, the lower portion 46 of the secondary piston 27 is pushed down by the primary piston 26. Then, the secondary piston 27, the air motor 31, the planetary reduction gear 33 and the driver bit 11 are pressed down. In the middle of the downward movement of the secondary piston 27, the opening 53 of the secondary piston 27 opens. The compressed air is fed through the opening 53 and the compressed air passage 41 to the air motor 31, which then begins to be rotated. The rotation of the motor is transmitted via the reduction gear 33 to the driver bit 11 and makes the driver bit 11 to be rotated. Thus, the rotation of the driver bit 11 is synchronized with the downward movement of the secondary piston 27 which lowers the driver bit.

Figure 4:
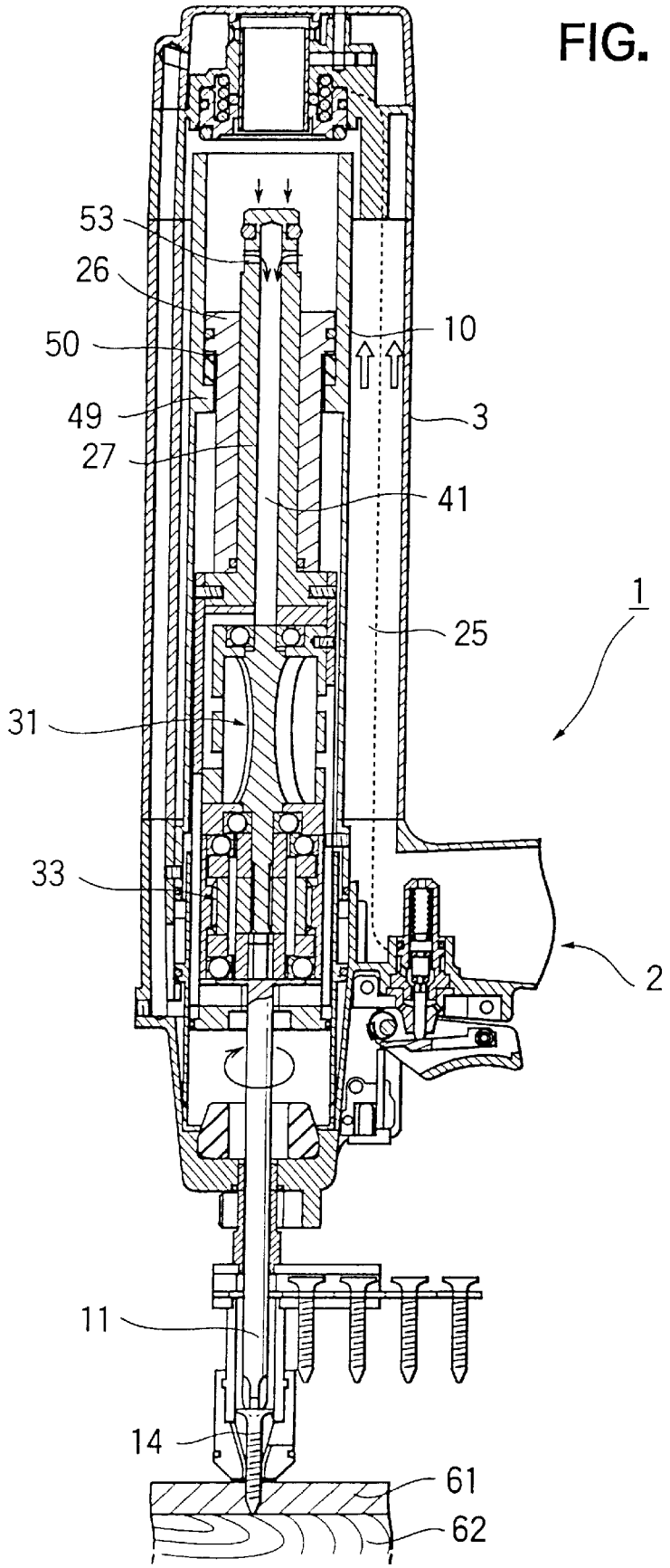
FIG. 4 is a sectional view showing the screw driving apparatus in which the tip of a screw has been driven to a predetermined depth in a workpiece.

When the driver bit 11 rotates, its tip is fitted into the groove on the screw head and the screw 14 being rotated is disengaged from the carrier strip 13 and the screw is sent to the chuck 18 with the downward movement or the advance of the secondary piston 27. A pressing force of 7 Kg to 10 Kg is required to detach the screw 14 from the carrier strip 13. Owing to its large area for receiving pressure, the primary piston 26 maintains a sufficient pressing force (that is, the force to press the screw in the advancing direction). Strong pressing by the primary piston 26 continues until the primary piston 26 abuts against the bumper 50 of the stop portion 49 of the cylinder 10. In other words, the strong pressing force by the primary piston 26 in its upper stationary position is maintained during the period including the steps of fitting the tip of the driver bit 11 into the head groove of the screw 14, detaching the screw 14 from the carrier strip 13, and advancing the driver bit still fitted in the screw 14. The strong pressing force is kept up to or around the time of piercing the tip of the screw through the attachment member 61 so as to reach another attachment member 62 beneath it as shown in FIG. 4. The screw is driven to a predetermined depth in the workpiece which comprises the attachment member 61 such as a gypsum board and the member 62 such as a wooden material.

Even after the advance of the primary piston 26 is stopped, as shown in FIG. 4, compressed air acts on the top surface of the secondary piston 27 for pressing down the secondary piston 27. The pressing force is weaker than that of the primary piston 26 since the secondary piston has a smaller area for receiving pressure. It is just enough to give a weak pressing force of 2 Kg to 3 Kg to the driver bit 11. On the other hand, through the opening 53, the compressed air passage 41 of the secondary piston 27 is continuously fed with compressed air for the air motor 31 so that the driver bit 11 keeps rotating. Accordingly, the screw 14 in engagement with the tip of the driver bit 11 is screwed into the attachment member 62 by the rotating driver bit 11. As this screwing-in allows the screw to get into the member 62 by itself, the pressing force of the driver bit 11 onto the screw, which is as weak as 2 kg to 3 kg, is enough to drive the screw properly. FIG. 5 shows the state of the completion of the driving.

As described in the above, upon pulling the trigger lever 6 in the stationary position, the driver bit 11 is advanced with a strong pressing force by the primary piston 26 until the screw is driven to the predetermined depth, at which its tip abuts against the member 62 or workpiece after piercing through the attachment member 61. When the screw 14 abuts on the member 62, the advance of the primary piston 26 is stopped. Thereafter, the screw being rotated is screwed into the member 62. The driver bit 11 is advanced by a weak pressing force of only the secondary piston 27. Therefore, the reaction that the driver bit is raised, which is produced when the screw 14 is screwed into the member 62, is reduced a lot or substantially eliminated. At the same time, the screw is functioned effectively so as to be screwed in reliably. Besides, the time required for the entire driving can be shortened as a strong pressing force by the primary piston 26 is used until the screw is driven to a predetermined depth in the workpiece.

When the driving is completed as shown in FIG. 5, the O-ring 51 at the upper end of the advanced secondary piston 27 comes in contact with the hollow portion of the primary piston 26 to form a seal. This blocks the opening 53 to the compressed air passage 41. The compressed air fed to the air motor 31 is stopped to suspend the rotation of the driver bit 11. As there is no further rotation of the screw, the screw is not screwed in unnecessarily deeply nor the groove on the screw head is broken. Since the supply of compressed air to the air motor 31 is stopped, the compressed air in the reservoir 25 comes into an upper portion of the cylinder 10 and a part of the compressed air is fed via the check valve 55 to the return discharge path 57 and accumulates there while the rest of it is discharged to the atmosphere through the compressed air escape hole 59 (FIG. 1) at the upper end of the body 3.

Releasing the trigger lever 6 as shown in FIG. 6 starts return operation. When the trigger lever 6 is released, the compressed air in the handle 2 is fed through the trigger valve 21 and the passage 22 to the main valve chamber 23, and then the main valve 19 is pushed down to its lower stationary position to seal the upper end of the cylinder 10. By this seal, feeding compressed air to the upper portion of the cylinder 10 is stopped and the air in the portion is discharged to the atmosphere gradually through the compressed air escape hole 59 formed on the upper side of the secondary cylinder 29, reducing the pressure on the top surfaces of the primary piston 26 and the secondary piston 27.

On the other hand, the compressed air in the return discharge path 57 is sent below the planetary type reduction gear 33 through the hole 58 in the lower portion of the cylinder 10. The compressed air acts to push up the reduction gear 33 together with the air motor 31 and the secondary piston 27. When the pressure in the upper portion of the cylinder 10 decreases to a level below the pressure which presses up the reduction gear 33, the reduction gear 33, the air motor 31 and the secondary piston 27 are pushed up. When they are pressed up, the air above the secondary piston 27 is partially discharged to the atmosphere via the compressed air escape hole 59 and the rest is sent through the check valve 55, the return discharge path 57 and the holes 58 to the cylinder below the planetary reduction gear 33. This air feeding maintains a higher pressure in the lower portion of the cylinder 10 than in the upper portion of it so as to push up the driver bit 11, the planetary reduction gear 33, the air motor 31 and the secondary piston 27. The large-diameter lower portion of the secondary piston 27 comes into engagement with the primary piston 26 to press up the primary piston 26 so that the apparatus returning to the stationary position shown in FIGS. 6 and 1.

INDUSTRIAL APPLICABILITY

According to the present invention, until a screw is driven to a predetermined depth in a workpiece, the screw can be driven at a high speed with a strong pressing force by the primary piston, and then screwing-in is carried out with a weak pressing force of about 2 Kg to 3 Kg. This substantially minimizes the reaction which tends to raise the driver bit when the screw is screwed into the workpiece. Since this arrangement also ensures proper screwing-in of screws, screw driving operation can be carried out easily and speedily, which is desirable for construction work among others. As the screw driving apparatus of this invention is of the structure that the driver bit is pressed by the primary and secondary pistons, the apparatus is very simple and can be constructed compactly as a whole. The driver bit is rotated synchronizedly with movement of the secondary piston and rotation is stopped when driving of the screw has been completed so that excessive screwing-in of screws can be prevented.

The present invention may be embodied in various forms without departing from the spirit or essetial characteristics of it. Therefore, the foregoing is just an example in all senses and should not be interpreted restrictive. The scope of the present invention is defined by the claims and the text of the specification imposes no limitation on them. In addition, all variations or modification which belong to the equivalents to the claims are within the scope of the present invention.

We claim:

1. A screw driving method comprising steps of fitting the tip of a driver bit into the groove on a screw head, disengaging the fitted screw from a screw carrier strip under a forward stroke force of the driver bit, driving the tip of the screw to a predetermined depth in a workpiece, and screwing the screw in while rotating the driver bit; characterized in that the screw driving method comprises: steps of driving a primary piston of a large diameter together with a secondary piston of a small diameter which reciprocatingly passes through the primary piston, so as to advance the driver bit with a strong pressing force by the primary piston during a period between the step of fitting the tip of the driver bit into the groove on the screw head and the step of driving the tip of the screw to the predetermined depth in the workpiece; and when the screw is screwed into the workpiece after the driving of the screw into the workpiece, stopping advance of the primary piston and advancing the driver bit with a weak pressing force by only the secondary piston which is continuously advanced.

2. A screw driving apparatus which has a cylinder, piston means reciprocating in the cylinder by means of compressed air, a driver bit driven by said piston means; and an air motor to rotate the driver bit, wherein the tip of the driver bit is fitted into the groove on the head of a screw, the fitted screw is disengaged from a screw carrier strip by means of a forward stroke force of the driver bit, the tip of the screw is driven to a predetermined depth in a workpiece and the screw is screwed into the workpiece by the rotating driver bit; characterized in that said piston means comprise: a hollow primary piston capable of reciprocating axially with respect to the cylinder in contact with the inner wall of the cylinder; and a secondary piston capable of reciprocating in the primary piston and piercing through the hollow portion of the primary piston axially with respect to the cylinder; and said secondary piston is integrally connected to the driver bit through the air motor with said secondary piston having a compressed air passage formed to feed the compressed air from the cylinder to the air motor; the primary piston has a compressed air receiving area larger than the pressure receiving area of the secondary piston; the apparatus is adapted to advance the driver bit with a strong pressing force by the primary piston within the advanced primary and secondary pistons during a period that the tip of the driver bit is fitted into the groove of the screw head and then the tip of the screw is driven to the predetermined depth in the workpiece; and the apparatus further comprises means to stop the advance of the primary piston after the screw has been driven into the workpiece so that the driver bit can be advanced with a weak pressing force caused only by the further advanced secondary piston.

3. The apparatus according to claim 2 wherein an opening is formed in an upper portion of the secondary piston and the opening remains closed when the secondary piston is in its stationary position, but the compressed air in the cylinder is fed to the air motor through the opening when the secondary piston is advanced.

4. The apparatus according to claim 3 further comprising means to stop feeding compressed air to the air motor by sealing the compressed air passage in the secondary piston when the secondary piston reaches the most advanced position in which driving of the screw is completed.

* * * * *

UNITED STATES PATENT AND TRADEMARK OFFICE

CERTIFICATE OF CORRECTION

PATENT NO. : 5,862,724
DATED : January 26, 1999
INVENTOR(S) : Ken Arata et al.

It is certified that error appears in the above-identified patent and that said Letters Patent is hereby corrected as shown below:

On the Title Page

Item [30], column 1, under "Foreign Application Priority Data", line 1, replace "Sep. 2, 1996" with --Feb. 9, 1996--.

Column 2, immediately after line 6, insert the following:

--*Attorney, Agent, or Firm*—Brinks Hofer Gilson & Lione--.

Signed and Sealed this

Sixth Day of July, 1999

*Attest:*

Q. TODD DICKINSON

*Attesting Officer*

*Acting Commissioner of Patents and Trademarks*